US011628533B2

(12) United States Patent
Andersson et al.

(10) Patent No.: US 11,628,533 B2
(45) Date of Patent: Apr. 18, 2023

(54) FLOOR GRINDING MACHINE, HANDLE FOR FLOOR GRINDING MACHINE AND METHOD OF SETTING A HANDLE FOR A FLOOR GRINDING MACHINE

(71) Applicant: HUSQVARNA AB, Huskvarna (SE)

(72) Inventors: Fredrik Andersson, Norrköping (SE); David Käcker, Norrköping (SE); Andreas Fogelberg, Söderköping (SE)

(73) Assignee: HUSQVARNA AB, Huskvarna (SE)

( * ) Notice: Subject to any disclaimer, the term of this patent is extended or adjusted under 35 U.S.C. 154(b) by 1097 days.

(21) Appl. No.: 16/306,066

(22) PCT Filed: Jun. 1, 2017

(86) PCT No.: PCT/EP2017/063373
§ 371 (c)(1),
(2) Date: Nov. 30, 2018

(87) PCT Pub. No.: WO2017/207721
PCT Pub. Date: Dec. 7, 2017

(65) Prior Publication Data

US 2019/0193230 A1 Jun. 27, 2019

(30) Foreign Application Priority Data

Jun. 3, 2016 (SE) ..... 1650786-5

(51) Int. Cl.
*B24B 7/18* (2006.01)
*B25F 5/02* (2006.01)

(52) U.S. Cl.
CPC ..... *B24B 7/186* (2013.01); *B24B 7/18* (2013.01); *B25F 5/02* (2013.01)

(58) Field of Classification Search
None
See application file for complete search history.

(56) References Cited

U.S. PATENT DOCUMENTS 1,974,136 A 9/1934 Emmons
4,191,397 A 3/1980 Kassai
(Continued)

FOREIGN PATENT DOCUMENTS

CN 2598845 Y 1/2004
CN 201659468 U 12/2010
(Continued)

OTHER PUBLICATIONS

E-Space abstract of CN 201659468.
(Continued)

*Primary Examiner* — Joseph J Hail
*Assistant Examiner* — Dana Lee Poon
(74) *Attorney, Agent, or Firm* — Burr & Forman LLP

(57) ABSTRACT

The present disclosure provides a floor grinding machine (1) for grinding floor surfaces of stone or stone-like material. The machine comprises a machine frame (2), a grinding head (3), supported by the machine frame (2), a motor (4), supported by the machine frame (2) and operatively connected to the grinding head (3), and a handle frame (5), extending from the machine frame (2), and pivotable relative to the machine frame (2). The machine further comprises a guide member (12), which is pivotable relative to the machine frame (2) and pivotable relative to the handle frame (5), a first locking device (14), for locking the guide member (12) relative to the handle frame (5), and a second locking device (13), for locking the guide member (12) relative to the machine frame (2). The disclosure further provides a handle for a floor grinding machine as well as methods of setting a position of a handle and methods of steering a floor grinding machine.

17 Claims, 8 Drawing Sheets

(56) References Cited

U.S. PATENT DOCUMENTS

| | | | | |
|---|---|---|---|---|
| 5,169,257 | A * | 12/1992 | Liou | A47C 20/045 297/356 |
| 5,253,384 | A * | 10/1993 | Joines | A47L 11/4058 15/49.1 |
| 5,605,493 | A | 2/1997 | Donatelli et al. | |
| 6,238,277 | B1 | 5/2001 | Duncan et al. | |
| 7,984,531 | B2 * | 7/2011 | Moore | A61F 5/0125 16/326 |
| 2002/0084117 | A1 | 7/2002 | Joseph | |
| 2006/0026781 | A1 | 2/2006 | Van Vliet | |
| 2009/0019652 | A1 * | 1/2009 | Goldberg | A47L 11/40 15/49.1 |
| 2009/0288270 | A1 * | 11/2009 | Yamashita | A47C 1/026 16/239 |
| 2011/0099748 | A1 | 5/2011 | Barous | |
| 2013/0084782 | A1 | 4/2013 | McCutchen et al. | |
| 2014/0230182 | A1 | 8/2014 | Ritscher et al. | |
| 2014/0273776 | A1 | 9/2014 | Leighton et al. | |
| 2016/0031061 | A1 | 2/2016 | Truong et al. | |
| 2017/0057042 | A1 * | 3/2017 | Winterfjord | B24B 7/18 |

FOREIGN PATENT DOCUMENTS

| | | | |
|---|---|---|---|
| CN | 202357004 | U | 8/2012 |
| CN | 202908627 | U | 5/2013 |
| CN | 203471743 | U | 3/2014 |
| CN | 204548356 | U | 8/2015 |
| CN | 105150041 | A1 | 12/2015 |
| DE | 202015100403 | U1 | 3/2015 |
| EP | 1604780 | B1 | 3/2007 |
| EP | 1806206 | A1 | 7/2007 |
| EP | 1942238 | A1 | 7/2008 |
| EP | 2329914 | A2 | 6/2011 |
| EP | 2329915 | A2 | 6/2011 |
| EP | 2561959 | A1 | 2/2013 |
| GB | 321860 | A | 11/1929 |
| GB | 2232367 | A | 12/1990 |
| GB | 2410206 | A | 7/2005 |
| KR | 20110004186 | U | 4/2011 |
| NL | 1014015 | C2 | 7/2001 |
| WO | 0001291 | A1 | 1/2000 |
| WO | 03076131 | A1 | 9/2003 |
| WO | 2007021191 | A2 | 2/2007 |
| WO | 20130106917 | A1 | 7/2013 |
| WO | 2015167376 | A1 | 11/2015 |

OTHER PUBLICATIONS

E-Space abstract of CN 203471743.
International Search Report for International Application No. PCT/EP2017/063375, dated Aug. 9, 2017 (3 pages).
E-Space abstract of CN 202908627.
E-Space abstract of DE 202015100403.
International Search Report for Swedish Application No. 1650788-1, dated Dec. 30, 2016 (2 pages).
International Search Report for International Application No. PCT/EP2017/063374, dated Nov. 23, 2017 (5 pages).
International Search Report for Swedish Application No. 1650787-3, dated Jan. 30, 2017 (2 pages).
International Search Report for International Application No. PCT/EP2017/063373, dated Mar. 5, 2018 (6 pages).
E-Space abstract of NL 1014015.
E-Space abstract of CN 105150041.
E-Space abstract of CN 202357004.

* cited by examiner

FLOOR GRINDING MACHINE, HANDLE FOR FLOOR GRINDING MACHINE AND METHOD OF SETTING A HANDLE FOR A FLOOR GRINDING MACHINE

CROSS-REFERENCE TO RELATED APPLICATIONS

This application claims priority to International Application No. PCT/EP2017/063373, filed Jun. 1, 2017 and titled "FLOOR GRINDING MACHINE, HANDLE FOR FLOOR GRINDING MACHINE AND METHOD OF SETTING A HANDLE FOR A FLOOR GRINDING MACHINE," which in turn claims priority from a Swedish Application having serial number 1650786-5, filed Jun. 3, 2016 and titled "FLOOR GRINDING MACHINE, HANDLE FOR FLOOR GRINDING MACHINE AND METHOD OF SETTING A HANDLE FOR A FLOOR GRINDING MACHINE," both or which are incorporated herein by reference in their entireties.

TECHNICAL FIELD

The present disclosure relates to floor grinding machines, and in particular to floor grinding machines adapted for grinding floors of stone or stone-like materials, such as limestone, sandstone, marble, slate, granite, concrete or terrazzo.

BACKGROUND

Floor grinding machines are known and used in polishing or grinding floor surfaces, either with the purpose of producing a level and/or glossy floor surface, or with the purpose of renovating such a surface which has deteriorated due to e.g. wear, or which has been damaged.

A floor grinding machine for this type of grinding typically comprises a machine frame, which carries a motor that is operatively connected to a grinding head.

In a particular class of floor grinding machines, such a grinding head may be rotatable relative to the machine frame. The grinding head may carry a plurality of grinding disks, each of which may be rotatable relative to the grinding head. Such a grinding head is typically referred to as a planetary type grinding head.

These floor grinding machines are usually equipped with grinding elements in the form of bonded abrasives, i.e. abrasives in the form of a three-dimensional body comprising abrasive particles and a matrix material, which may be a polymer material or a metallic material. As another option, the machines may be equipped with cutting elements, adapted, for example for removal of glue, paint, lacquer or other surface treatments from a floor surface.

The machine may typically be supported by its grinding head and often also by a pair of wheels, which may be arranged behind the grinding head, as seen in a forward direction of the machine. Optionally, the machine may also be supported by one or more further wheels, which may be used to control the pressure exerted by the grinding head on the floor.

The pair of wheels may be driven. Optionally, they may be individually drivable, such that a direction of travel of the machine may be controlled.

The floor grinding machine may comprise a handle, which is connected to the frame and provides possibility for the operator to hold, push, pull and/or steer the machine.

Typically, the handle comprises a handle frame, which may be adjustable relative to the machine frame. The handle frame may comprise a handle bar and a user interface, which may include buttons, levers and/or indicators, such as lamps, gauges or displays.

One example of a known machine of this type is disclosed in WO03076131A1.

An ergonomic floor grinding machine for users with different body conditions, such as height, arm length and strength, is needed.

Further, the floor grinding machine is big in size, which is not convenient when it is not in use, for example when it is to be stored or transported.

Therefore, there remains a need for an improved floor grinding machine, which can at least partly alleviate above drawbacks.

SUMMARY

An object of the present disclosure is to provide an improved floor grinding machine for grinding floor surfaces of stone or stone-like materials.

A particular object is to provide a floor surfacing machine which is improved in terms of ergonomics while being compact enough to enable it to be stored or transported.

The invention is defined by the appended independent claims, with embodiments being set forth in the appended dependent claims in the following description and in the attached drawings.

According to a first aspect, there is provided a floor grinding machine for grinding floor surfaces of stone or stone-like material. The machine comprises a machine frame, a grinding head, supported by the machine frame, a motor, supported by the machine frame and operatively connected to the grinding head, and a handle frame, extending from the machine frame, and pivotable relative to the machine frame. The machine further comprises a guide member, which is pivotable relative to the machine frame and pivotable relative to the handle frame, a first locking device, for locking the guide member relative to the handle frame, and a second locking device, for locking the guide member relative to the machine frame.

The floor materials may have a Knoop hardness of more than 130, preferably more than 135 or 140, and may thus comprise stone or stone-like materials, such as limestone, sandstone, marble, slate, granite, concrete or terrazzo.

By using first and second locking devices, it is possible to provide a handle with a memory function, such that the handle quickly can be brought to/from a preferred working position from/to a transport or storage position.

The guide member may be pivotable relative to the machine frame coaxially with the handle frame.

As an alternative, the guide member may be pivotable relative to the machine frame about a first axis and the handle frame is pivotable relative guide member about a second axis. The first and second axes are spaced from each other with a distance of less than 50% of length of handle frame, preferably less than 30%.

The floor grinding machine may further comprise a pivot angle limiting device.

The pivot angle limiting device may limit the pivoting movement between the guide member and one of the machine frame and the handle frame.

The first locking device may provide a continuum of relative positions between the handle frame and the guide member.

The second locking device may provide a continuum of relative positions between the machine frame and the guide member.

Alternatively, or as a supplement, the first locking device may provide at least two fixed relative positions between the handle frame and the guide member.

Moreover, the second locking device may provide at least two fixed relative positions between the machine frame and the guide member.

One of the locking devices may provide a smaller angle between a pair of adjacent fixed positions than the other one.

One of the locking devices may provide a greater angle difference between extreme positions than the other one.

The handle frame may be pivotable relative to the machine frame between at least one transport position and at least one working position.

The transport position may be located such that a movement from the working position to the transport position comprises lifting the handle frame upwardly.

The transport position may be located such that a movement from the working position to the transport position comprises lowering the handle frame.

The handle frame may carry a user interface.

According to a second aspect, there is provided a method for setting a position of a handle of a floor grinding machine for grinding floor surfaces of stone or stone-like material. The method comprises setting a position of a handle frame relative to a guide member, and setting a position of the guide member relative to a machine frame.

In the method, setting a position of a handle frame relative to a guide member may comprise pivoting the handle frame relative to the machine frame and relative to the guide member, and locking the handle frame relative to the guide member.

In the method setting a position of the guide member relative to a machine frame may comprise pivoting the handle frame with the guide member relative to the machine frame, and locking the guide member relative to the machine frame.

The pivoting motions may be performed about axes which are spaced apart by less than 50% of a length of the handle frame, preferably by less than 30% and most preferably about axes that are coaxial, or even the same.

According to a third aspect, there is provided a handle for a floor grinding machine for grinding floor surfaces of stone or stone-like material. The handle comprises an attachment portion, by which the handle is attachable to a handle frame of the machine, a first cross portion, extending laterally at least on one side of the attachment portion and having a width sufficient for it to be gripped by a user's hand, a second cross portion, extending substantially parallel with, and spaced from, the first cross portion and having a width sufficient for it to be gripped by a user's hand.

In this context, "substantially parallel" means coplanar, i.e. coplanar+/−less than 15°, preferably less than +/−less than 10° or +/−less than 5°.

Such width may be on the order of 10-20 cm on each side of the attachment portion.

The second cross portion may be spaced from the first cross portion in a direction substantially opposite to a forward moving direction of the machine.

"Substantially opposite" means opposite+/−20°, preferably +/−10° or +/−5.

The handle may further comprise a respective longitudinal member, extending substantially parallel with the forward moving direction of the machine on a respective side of the attachment portion and substantially perpendicular to the cross portions and providing respective bridges between distal portions of the first and second cross portions.

By "substantially perpendicular" is meant perpendicular+/−20°, preferably +/−10° or +/−5°.

The cross portions and the longitudinal members may be integrated with each other.

The term "integrated" may be understood as fixedly connected or formed in one piece.

The handle may further comprise respective first vertical members, extending at an angle of 0°-45°, preferably 10°-35°, in a plane containing a forward direction, and at an angle of 0°-45° in a plane containing a machine lateral direction, from respective distal portions of the first cross portion.

Preferably the first vertical members extend downwardly from the first cross section.

The handle may further comprise respective second vertical members, extending at an angle of 0°-45°, preferably 10°-35°, in a plane containing forward direction, and at an angle of 0°-45° in a plane containing machine lateral direction, from respective distal portions of the second cross portion.

Preferably the second vertical members extend downwardly from the second cross section.

The longitudinal members may extend from a respective distal portion of the first vertical members.

The longitudinal members may extend from a respective distal portion of the second vertical members.

The cross portions, the vertical members and the longitudinal members may be integrated with each other.

A length of the longitudinal member may be equal to or shorter than a length of the first and the second cross portions.

The attachment portion may comprise at least one rotation limiting member, adapted to limit rotation of the handle when received in a handle mount.

According to a fourth aspect, there is provided a floor grinding machine floor grinding machine for grinding floor surfaces of stone or stone-like material, the machine comprising a handle as described above.

The handle may be arranged in a first orientation with the first cross member in front of second cross member.

Alternatively, the handle may be arranged in a second orientation with the second cross member in front of the first cross member.

In particular, the handle may be rotatable relative to a handle frame between the first orientation and the second orientation.

According to a fifth aspect, there is provided method for horizontally steering a floor grinding machine for grinding floor surfaces of stone or stone-like material. The method comprises gripping by a user's hand a first vertical member of a handle of the machine, causing a wrist or lower arm portion, associated with the hand, to contact a second vertical member of the handle, which is substantially parallel to the first vertical member and spaced apart from the first vertical member in a direction of forward movement of the machine, and using the wrist or lower arm portion to apply a force directed substantially perpendicular to the direction of forward movement, such that the machine is caused to turn towards a direction opposite to the direction of the force.

The method may further comprise gripping by the user's second hand another first vertical member of the handle, causing a second wrist or lower arm portion, which is associated with the second hand, to contact another second vertical member of the handle, which is substantially parallel to the another first vertical member and spaced apart from the another first vertical member in the direction of forward movement of the machine, and using the another wrist or lower arm portion to apply a second force directed substantially parallel to the direction of the force.

According to a sixth aspect, there is provided a method for vertically steering a floor grinding machine for grinding floor surfaces of stone or stone-like material. The method comprises gripping by a user's hand a first cross portion of a handle of the machine, causing a wrist or lower arm portion, which is associated with the hand, to contact a second cross portion of the handle, which extends substantially parallel with and spaced apart from the first cross portion in a direction substantially opposite to forward movement of the machine, and using the wrist or lower arm portion to apply a force directed substantially perpendicular to the direction of forward movement, such that the machine is caused to tilt towards a direction opposite to the direction of the force.

The method may comprise gripping by the user's second hand the first cross portion, causing a second wrist or lower arm portion, which is associated with the second hand, to contact the second cross portion, and using the another wrist or lower arm portion to apply a second force directed substantially parallel to the direction of the force.

The cross portions may preferably be substantially coplanar, i.e. coplanar+/−less than 15°, preferably less than +/−less than 10° or +/−less than 5°. Grip of cross portion may be on respective sides of a mounting portion.

In the method, gripping by a user's hand the first cross portion may comprise placing the user's two hands spaced apart from each other.

In the method, the user's two wrist or lower arm portions may be substantially parallel to each other.

DETAILED DESCRIPTION

Figure 1A:
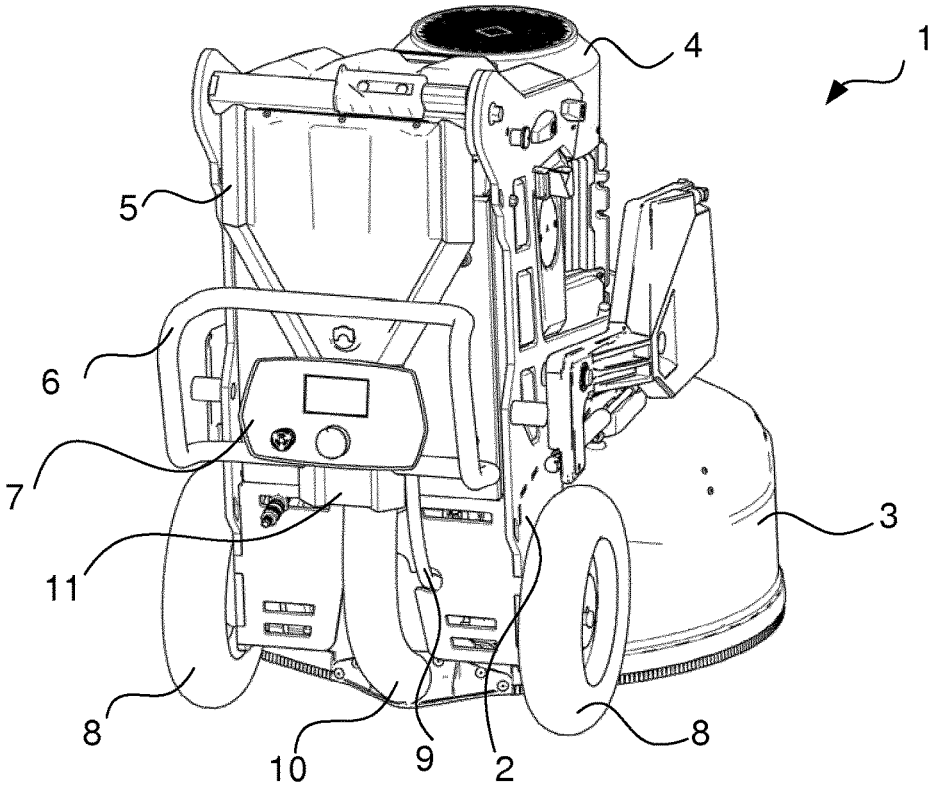
FIGS. 1*a*-1*d* are schematic perspective views of a floor grinding machine.
Figure 1B:
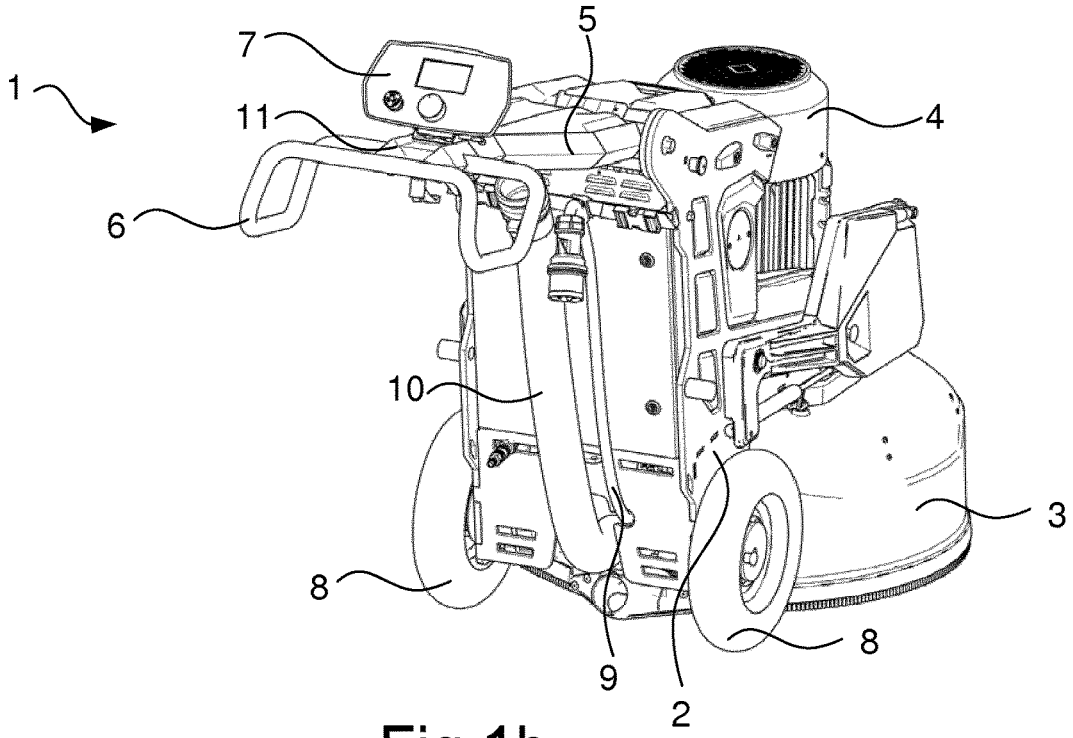
Figure 1C:
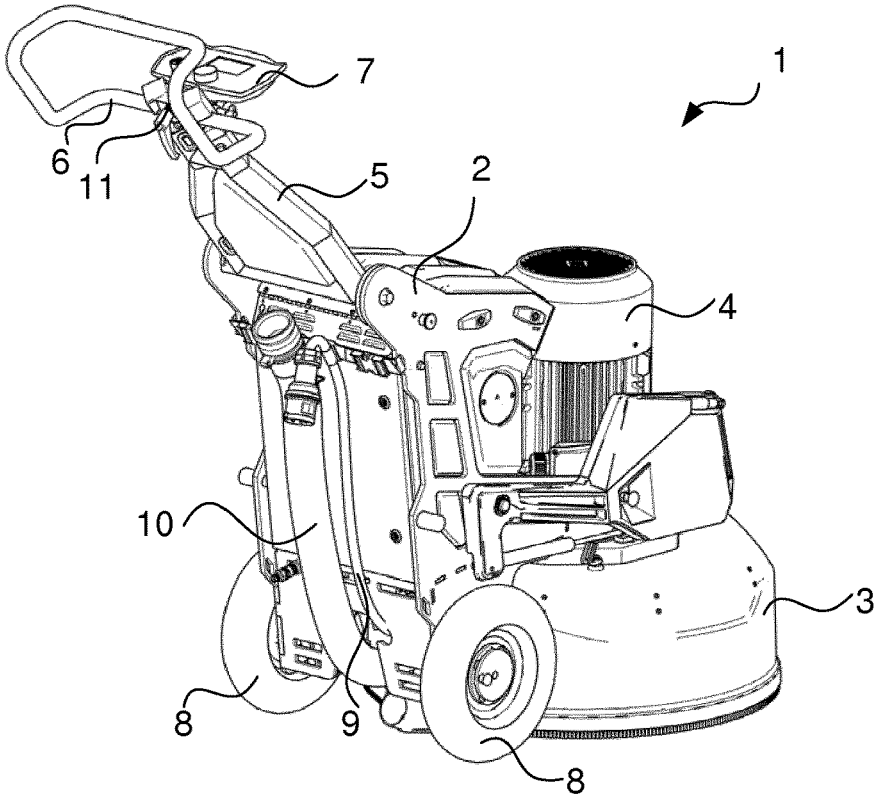

FIG. 1 schematically illustrates a floor grinding machine 1. The grinding machine 1 comprises a machine frame 2 which supports a grinding head 3 and a motor 4. The grinding head 3 is driven by the motor 4 to rotate.

The grinding head 3 may comprise a casing, which is rotatable inside a hood.

The grinding head 3 as illustrated herein is formed as a planetary type grinding head, i.e. the grinding head casing is rotatable relative to the machine frame 2, and in turn carries two or more grinding disks, each of which being rotatable relative to the casing.

The hood may be arranged to enclose the grinding head 3, such that grinding residues are contained and can be readily collected by e.g. a collection device as will be further described.

The machine 1 may thus further comprise a collection device for collecting grinding residues, such as dust, water and the like. The collection device may comprise a hood connector, such that a space enclosed by the hood is in fluid connection with a dust collector, and optionally a channel, such as a hose or a pipe 10. A hose 10 leading to the dust collector, such as a vacuum cleaner, may be directly connectable to the hood connector, or to the channel.

The machine 1 may be supported by wheels, such as by a pair of coaxial wheels 8. The wheels may provide part of the support, with additional, or even most, support provided by the grinding head 3.

The wheels 8 may be freely rotatable, whereby the machine 1 may be propelled entirely by being pushed and/or pulled by the user.

As another option, the wheels 8 may be driven by one or more motors. For example, the wheels may be individually drivable, whereby steering of the machine 1 by e.g. radio control may be enabled.

The machine 1 may comprise a control unit, which contains functionality for controlling the machine 1 and/or feeding back information, such as setting a speed of the rotating discs, and reporting a temperature of the grinding discs.

The machine 1 may further comprise a handle frame 5 extending from an upper rear portion of the machine frame 2. The handle frame 5 may support a handle 6 for a user to grip and/or steer the machine 1, and optionally a user interface 7.

The user interface 7 may comprise an output device, such as a display, which may be a touch screen, for displaying information. The user interface may further comprise one or more input devices, such as a touch screen, buttons, knobs and/or a keyboard for the user to control the machine 1.

Figure 1D:
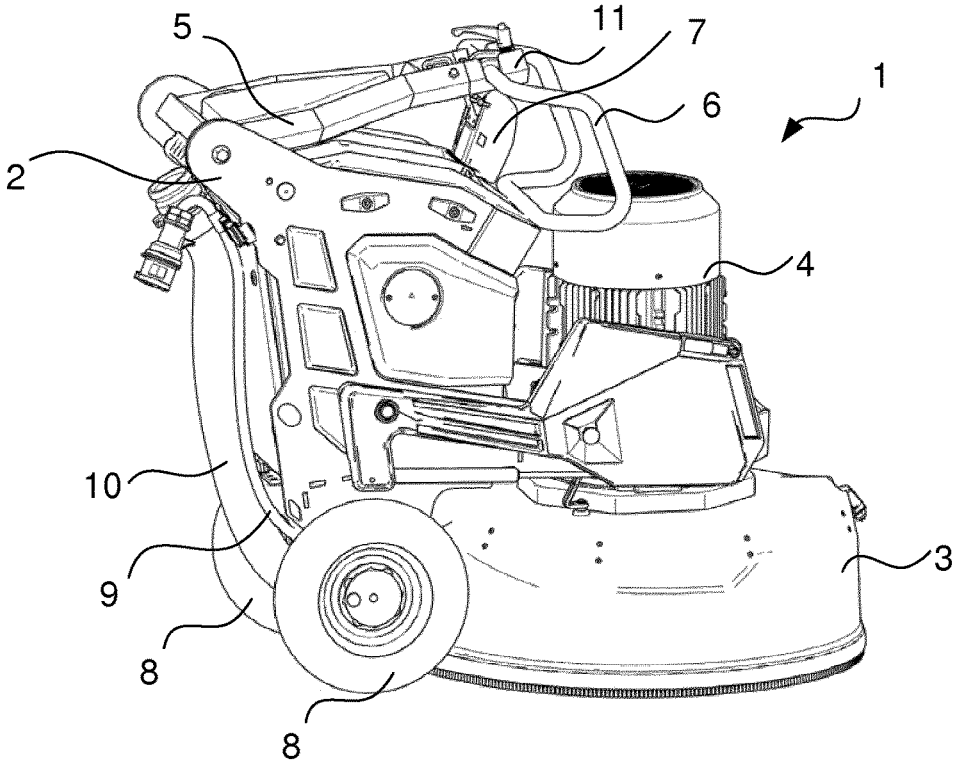

As indicated in FIGS. 1*a*-1*d*, the handle frame 5 is pivotable relative to the machine frame 2. In the illustrated example, the handle frame 5 is pivotable between four positions: a lower transport position (FIG. 1*a*), a lower operating position (FIG. 1*b*), an upper operating position (FIG. 1*c*) and an upper transport position (FIG. 1*d*).

Figure 2A:
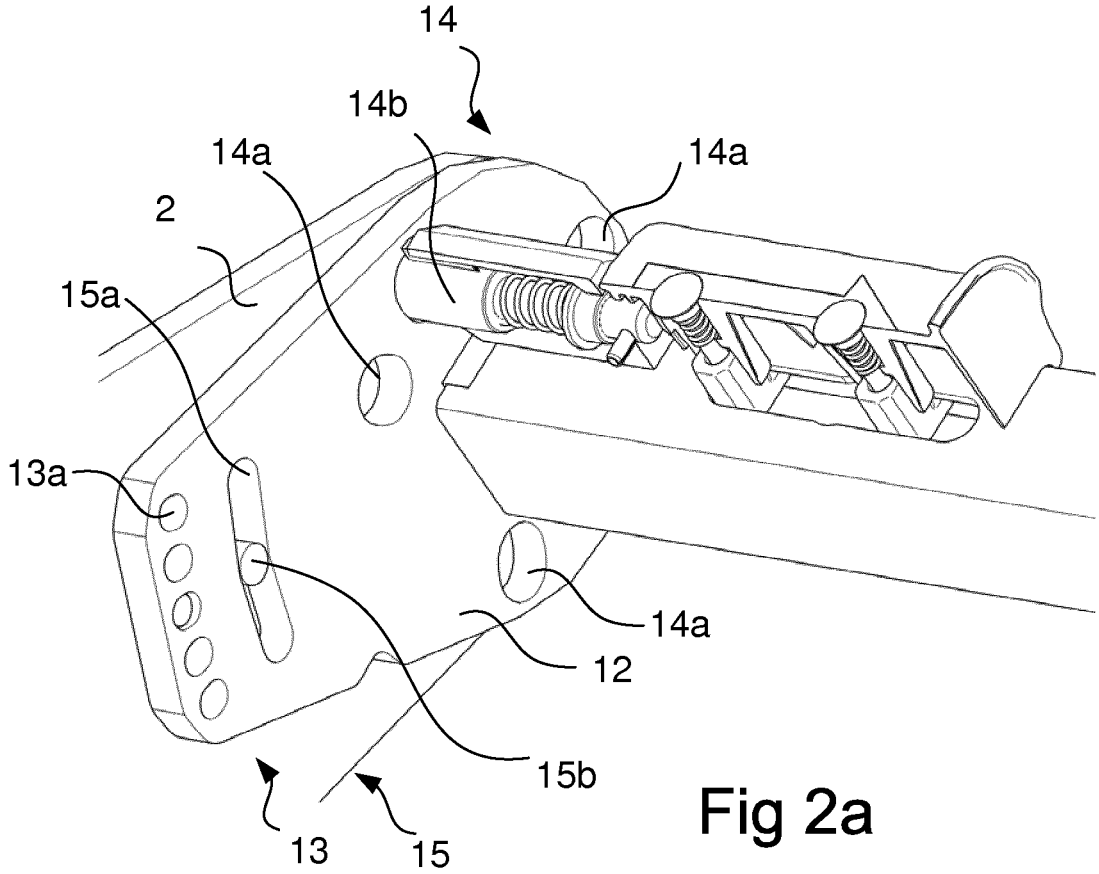
FIGS. 2*a*-2*b* schematically illustrate the guide member, the first locking device, and the second locking device.
Figure 2B:
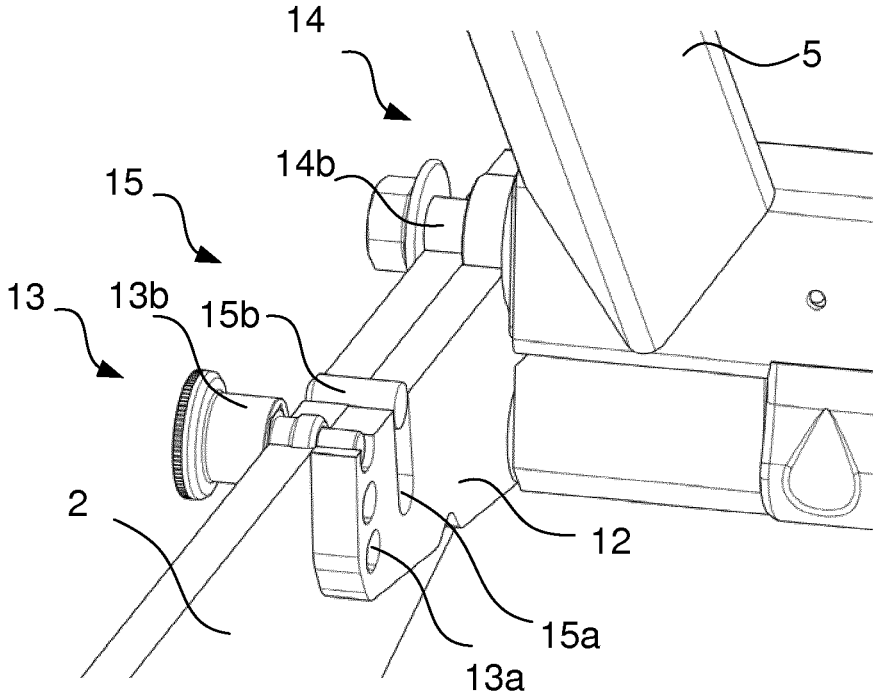
Figure 3A:
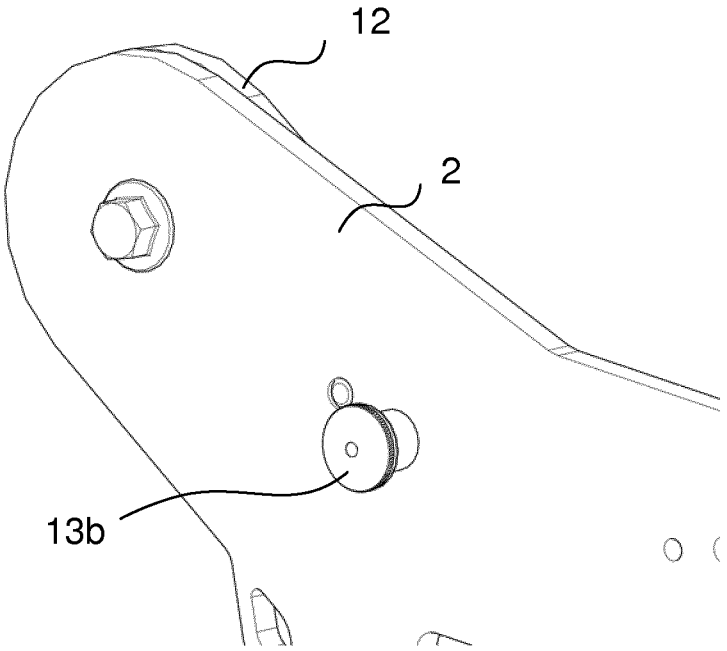
FIG. 3*a*-3*b* schematically illustrate a part of the machine frame connected to the guide member of FIGS. 2*a*-2*b*.
Figure 3B:
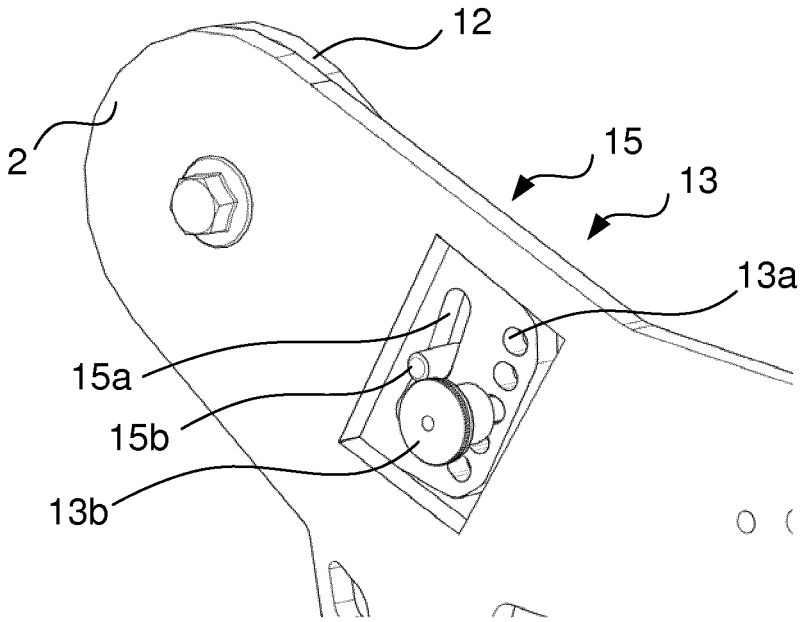

The handle frame 5 may be continuously pivotable, or it may be pivotable between a number of fixed positions. In the illustrated example, the handle frame 5 is pivotable between four fixed positions, as illustrated in FIGS. 1*a*-1*d*. Moreover, the position of the handle frame may be possible to fine tune. This may be done either continuously over a predetermined range, or over a number of fixed predetermined positions, as is illustrated in FIG. 2*a*.

To this end, the machine 1 may comprise a guide member 12, which is pivotable relative to the machine frame 2 and also pivotable relative to the handle frame 5.

To secure the handle frame 5 relative to the guide member 12, the machine 1 may comprise a first locking device 14, for locking the guide member 12 relative to the handle frame 5.

The locking device 14 may comprise a plurality of holes or recesses 14*a* formed in the guide member 12, each corresponding to one of the positions mentioned with reference to FIGS. 1*a*-1*d*, and a locking pin 14*b*, which is connected to the handle frame 5. In the illustrated example, the locking pin 14*b* is connected to the handle frame 5 by means of a spring, which biases the locking pin 14*b* towards the guide member 12.

It is understood that a similar locking function may be achieved in various ways, such as by means of a bolt, a snaplock device or the like.

The machine 1 may further comprise a second locking device 13, for locking the guide member 12 relative to the machine frame 2.

The guide member 12 may be pivotable relative to the machine frame coaxially with the handle frame 5.

The second locking device 13 may provide a continuum of relative positions between the machine frame 2 and the guide member 12.

Alternatively, the second locking device 13 may provide at least two predetermined relative positions between the machine frame 5 and the guide member 12. The predetermined relative positions may be provided by the locking holes or recesses 13*a*, as illustrated in FIGS. 2*a*-2*b* and 3*a*-3*b*.

The locking holes or recesses 13*a* may be formed along a curve following a segment of a circle having its center at the axis of rotation about which the guide member 12 is pivotable.

Optionally, a pivot limiting device 15 may be provided, and may comprise a slit 15*a*, which together with a guide pin 15*b* limits the maximum angle of rotation of the guide member 12 relative to the machine frame 2.

The second locking device may further comprise a second locking pin 13*b*, which may be provided with a biasing device for biasing the locking pin towards the hole or recess 13*a*.

With regard to the handle, the machine may function as follows.

A position selected from, e.g., the four positions illustrated in FIGS. 1*a*-1*d* may be selected by moving the first locking pin 14*b* towards the right in FIG. 2*a*, such that the first locking pin 14*b* is extracted from the hole or recess 14*a*.

The handle frame 5 may then be pivoted to the desired position. If the pin 14*b* is held out of the hole or recess 14*a*, pivoting may be achieved all the way to the desired position. If the pin 14*b* is released, then it may spring back into the next hole or recess 14*a*, as soon as it reaches it.

Once in the desired position, the pin 14*b* is allowed to rest in the hole or recess 14*a*.

If this desired position is one of the operating positions, then it may be desirable to fine tune the handle position.

This can be done by pulling the second pin 13*b* out of its associated hole or recess 13*a*. As the handle frame 5 is locked relative to the guide member 12 by the first locking device 14, the handle frame 5 will now pivot together with the guide member 12 until the pin 13*b* is released and allowed to spring back into the desired one of the holes or recesses 13*a*.

By leaving the second locking device 13 in its locked position, it is possible to again release the first locking device 14 and bring the handle frame 5 to one of the transport positions, in order to simplify transportation or storage of the machine 1.

When it is desirable to use the machine 1 again, the first locking device 14 is again released, and the handle frame 5 is pivoted to the desired position. However, now, the handle frame 5 will be brought to the position of the second locking device 13, where this was previously set. Hence, the handle frame 5 is effectively provided with a memory for the preferred setting of the handle frame 5.

Figure 4:
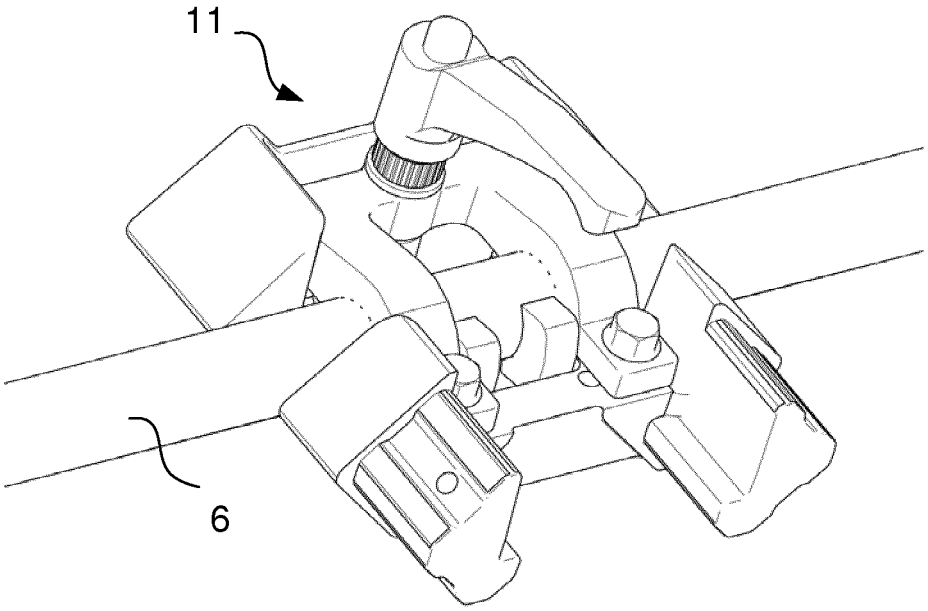
FIG. 4 schematically illustrates a handle frame head.

FIG. 4 illustrates a handle connection mechanism, which may be used to connect the handle 6 to the handle frame 5. This connection mechanism may essentially comprise a clamping device 11, which is used to clamp a attachment portion 6*f* of the handle 6.

The attachment portion 6*f* may comprise a positioning device, arranged to ensure that the handle 6, when received in the clamping device 11, is always correctly oriented.

This positioning device may also function as a rotation limiting device, which limits the possible positions between the handle 6 and the handle frame 5.

For example, the rotation limiting device may comprise one or more protrusions extending from the attachment portion 6*f*, and being arranged to cooperate with corresponding supports or abutments in the clamping device 11.

Figure 5:
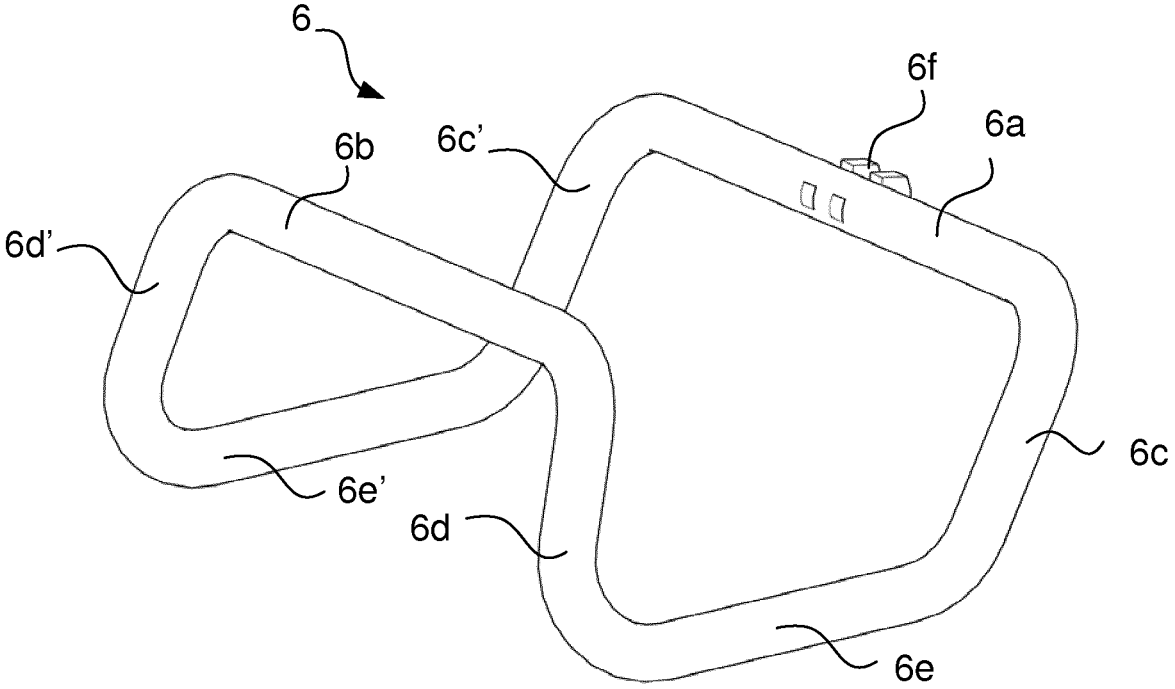
FIG. 5 schematically illustrates a handle.

One version of a handle 6 is illustrated in FIG. 5.

The handle 6 comprises an attachment portion 6*f*, by which the handle 6 is attachable to a handle frame 5 of the machine 1. From the attachment portion 6*f*, cross portions 6*a* extend laterally and substantially horizontally towards both sides.

A second cross portion 6*b*, which extends substantially parallel with the first cross portions 6*a*, is spaced from the first cross portions 6*a* in a forward movement direction of the machine 1. The spacing may be on the order of 10-30 cm, preferably 15-25 cm.

The spaced apart cross portions 6*a*, 6*b* may be interconnected by one or more other portions 6*c*-6*e*.

The handle 6 may comprise respective first vertical members 6*c*, 6*c*', 6*d*, 6*d*', extending less than +/−45° from the vertical direction, preferably less than +/−30° from the vertical direction, or less than +/−20° from the vertical direction, from respective distal portions of the first cross portions 6*a*.

The handle 6 may further comprise respective second vertical members 6*d*, extending less than +/−45° from the vertical direction, preferably less than +/−30° from the vertical direction, or less than +/−20° from the vertical direction, from respective distal portions of the second cross portion 6*b*.

The first and second vertical members 6*c*, 6*c*', 6*d*, 6*d*' may, but need not, be parallel. The first vertical members 6*c*, 6*c*' may present a greater angle to the vertical direction than the second vertical members 6*d*, 6*d*'. The angle of the first vertical members 6*c*, 6*c*' may be more than 5° greater than that of the second vertical members 6*c*, 6*c*', 6*d*, 6*d*', preferably more than 10° or more than 15°.

The handle 6 may comprises a respective longitudinally extending member 6*e*, 6*e*', extending substantially parallel with the forward moving direction of the machine on a respective side of the attachment portion 6*f* and substantially perpendicular to the cross portions and providing respective bridges between distal portions of the first and second cross portions 6*a*, 6*b*.

The cross portions 6*a*, 6*b* and the longitudinal members 6*e*, 6*e*' may be integrated with each other. For example, the entire handle 6 may be formed from one piece of material, such as a tube or rod, which has been bent into the desired shape, and ends of which may be joined together to form an endless member.

FIGS. 6*a*-6*d* schematically illustrate a locking device comprising a frictional locking device for preventing relative rotation between the machine frame 102 and the guide member 112, and a form based locking device for preventing relative rotation between the handle frame 5 and the guide member 112.

Figure 6A:
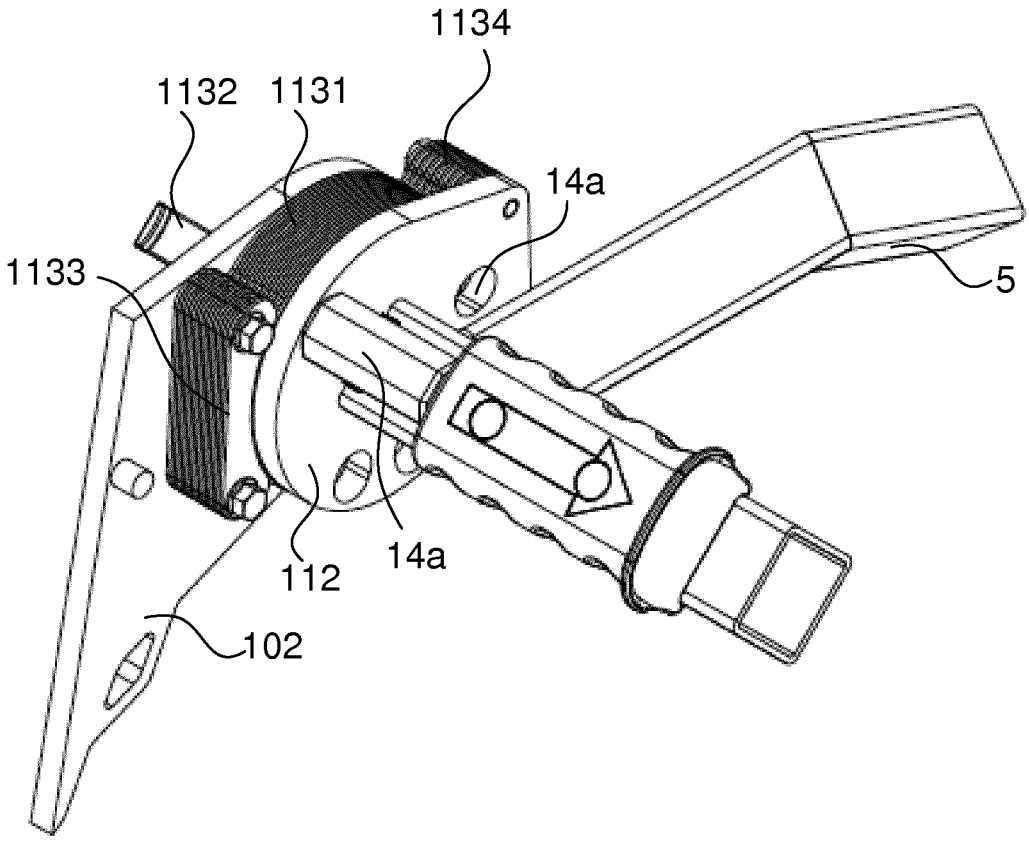
FIGS. 6*a*-6*d* schematically illustrate an alternative locking device.

Referring to FIG. 6*a*, there is illustrated a portion of a machine frame 102 and a portion of the handle frame 5. There is also a guide member 112.

A first locking device 14*a*, 14*b* is provided for locking the handle frame 5 relative to the guide member 112. This locking device 14*a*, 14*b* is arranged substantially as the one disclosed above, and includes a plurality of fixed position recesses 14*a* and a pin 14*b*, which is biased towards the guide member 112, such that it will enter the recesses 14*a* when aligned therewith.

A second locking device 1131, 1132, 1133, 1134 is provided for locking the guide member 112 relative to the machine frame 102. This second locking device comprises a lamellae package 1131 comprising a pair of lamellae sets 1133, 1134. A first one 1133 of the lamellae sets is fixedly connected to the machine frame 102 and a second one of the lamellae sets is fixedly connected to the guide member 112. In an area of overlap between lamellae from the different sets, lamellae from the respective sets are arranged alternatingly, such that in the area of overlap, every second lamella belongs to the set 1133 attached to the machine frame 102 and the remaining lamellae belongs to the set 1134 attached to the guide member 112.

Figure 6B:
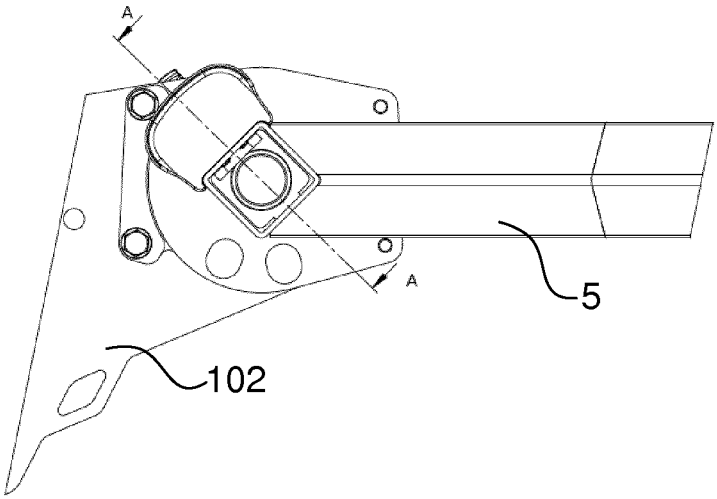

FIG. 6*b* is a side view of the handle arrangement illustrated in FIG. 6*a*.

Figure 6C:
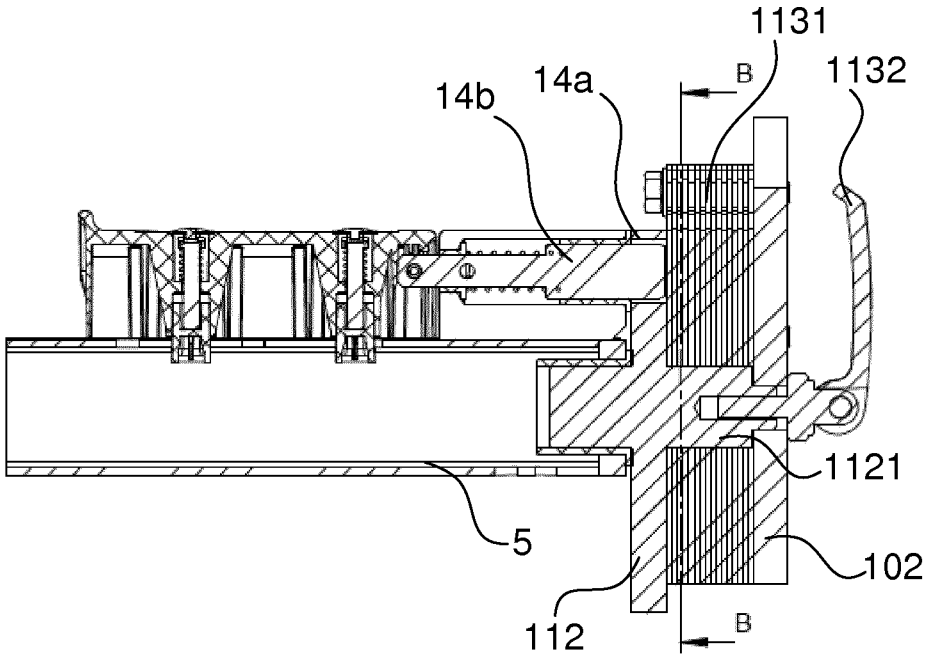

FIG. 6*c* is a cross sectional view taken along line A-A in FIG. 6*b*. FIG. 6*c* illustrates the guide member 112 being provided with an axle portion 1121, which extends partially through the lamella package 1131, in an area of overlap between the lamellae sets 1133, 1134.

A tensioner device, which is here illustrated as an excenter clamp 1132, engages the axle portion 1121 so as to provide a clamping force along the axial direction and thus between the guide member 112 and the machine frame 102.

Other types of tensioner devices may be used, such as nuts, bolts or the like.

Moreover, the lamella package may be dispensed with, in which case the guide member 112 may be clamped directly towards the machine frame 102 using an axial tensioner as illustrated in FIG. 6*c*.

Figure 6D:
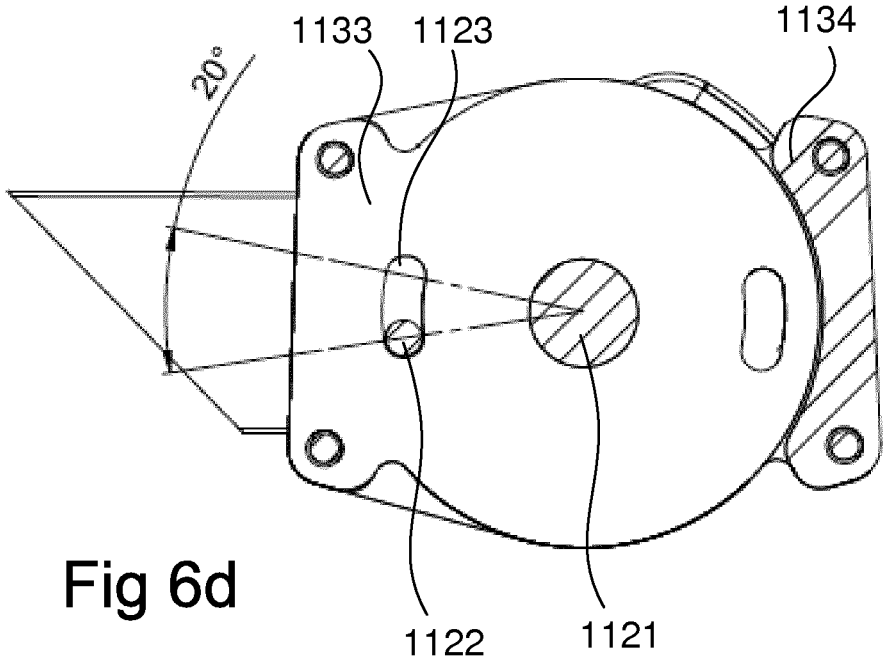

FIG. 6*d* is a cross sectional view taken along line B-B in FIG. 6*c* and illustrates how the relative angle of rotation between the guide member and the machine frame 102 may be limited. As illustrated, the maximum range of angles may be on the order of 0°-30°, preferably 15°-30° or about 20°.

Hence, an angle limiting device may be provided in the form of a pin 1122, which is slidable in a slit 1123 that is curved with a bending radius about the axle 1121. The pin 1122 may be attached to the guide member 112 and the slit 1123 may be provided in the machine frame 102 and in the lamella package 1131. Alternatively, the pin 1122 may be attached to the machine frame 102 and the slit 1123 may be provided in the guide member 112 and in the lamella package 1131.

Referring back to FIG. 1*b* and FIG. 1*c*, it is noted that the handle 6 is in a position where it extends rearwardly from the handle frame 5. These are both operating positions and are suitable to provide good leverage effect relative to the machine 1, e.g. for turning and/or tilting.

Figure 7A:
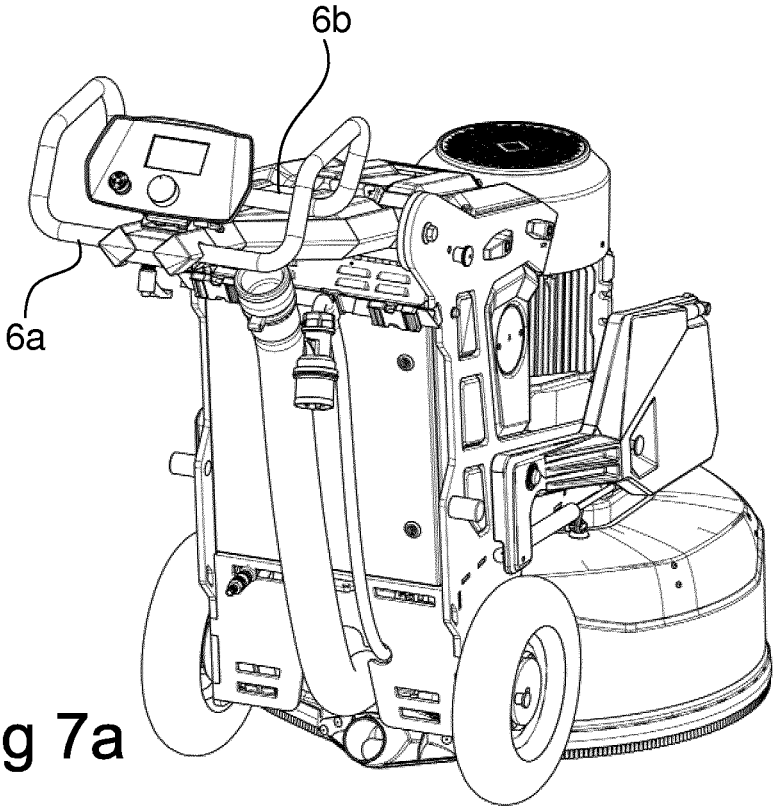
FIGS. 7*a*-7*b* schematically illustrate the machine with the handle in different positions.
Figure 7B:
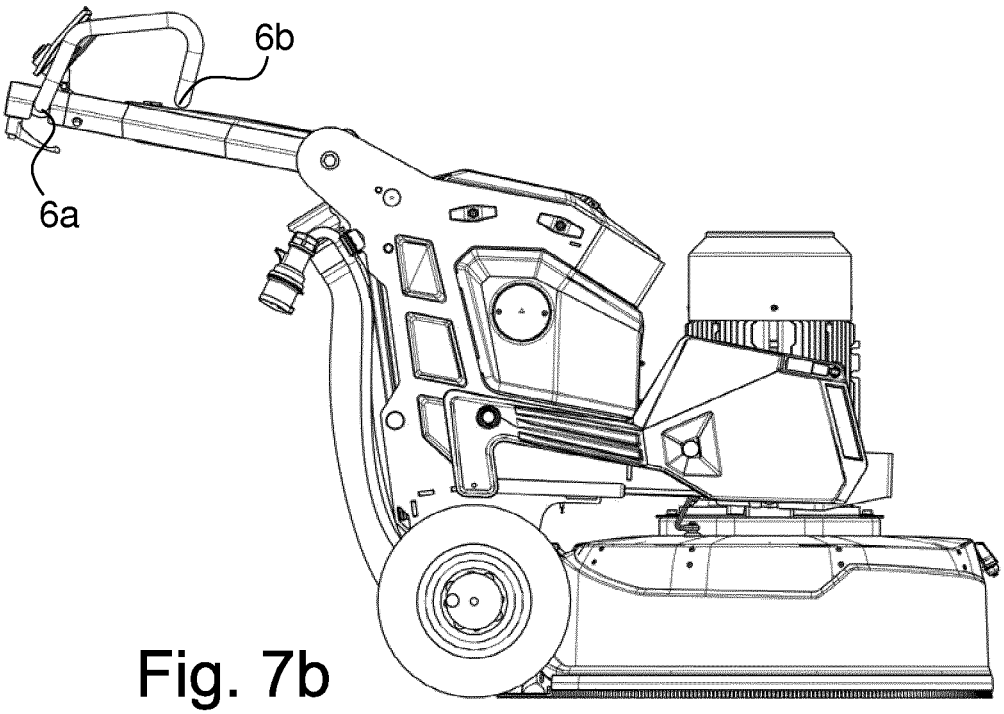

Referring to FIGS. 7*a*-7*b*, the handle 6 has instead been rotated upwardly and forwardly relative to the handle frame 5, such that the first cross member 6*a* and the attachment portion 6*f* are behind the second cross member 6*b*, as seen in the machine longitudinal direction, or in the forward direction.

This position may be advantageous when it is desirable to walk more closely behind the machine 1, e.g. in order to get a better view of the grinding result.

The invention claimed is:

1. A floor grinding machine for grinding floor surfaces, the machine comprising:

a machine frame, a grinding head supported by the machine frame, a motor supported by the machine frame and operatively connected to the grinding head, a handle frame extending from the machine frame and pivotable relative to the machine frame, a guide member which is pivotable relative to the machine frame and pivotable relative to the handle frame, a first locking device that selectively locks the guide member into physical engagement with the handle frame to prevent pivoting movement of the handle frame relative to the guide member, and a second locking device that selectively locks the guide member into physical engagement with the machine frame to prevent pivoting movement of the guide member relative to the machine frame;

wherein the guide member is pivotable relative to the machine frame about a first axis, the handle frame is pivotable relative guide member about a second axis, and the first and second axes are coaxial;

wherein the handle frame is prevented from pivoting relative to the machine frame, in either rotational direction, when the first locking device locks the guide member into physical engagement with the handle frame and the second locking device locks the guide member into physical engagement with the machine frame.

2. The floor grinding machine as claimed in claim 1, wherein the guide member is pivotable relative to the machine frame coaxially with the handle frame.

3. The floor grinding machine as claimed in claim 1, further comprising a pivot angle limiting device which limits the pivoting movement between the guide member and one of the machine frame and the handle frame.

4. The floor grinding machine as claimed in claim 1, wherein the first locking device provides a continuum of relative positions between the handle frame and the guide member.

5. The floor grinding machine as claimed in claim 1, wherein the second locking device provides a continuum of relative positions between the machine frame and the guide member.

6. The floor grinding machine as claimed in claim 1, wherein the first locking device provides at least two fixed relative positions between the handle frame and the guide member.

7. The floor grinding machine as claimed in claim 6, wherein one of the locking devices provides a smaller angle between a pair of adjacent fixed positions than the other one.

8. The floor grinding machine as claimed in claim 1, wherein the second locking device provides at least two fixed relative positions between the machine frame and the guide member.

9. The floor grinding machine as claimed in claim 1, wherein one of the locking devices provides a greater angle difference between extreme positions than the other one.

10. The floor grinding machine as claimed claim 1, wherein the handle frame is pivotable relative to the machine frame between at least one transport position and at least one working position, wherein the transport position is located such that a movement from the working position to the transport position comprises lifting the handle frame upwardly.

11. The floor grinding machine as claimed in claim 1, wherein the handle frame is pivotable relative to the machine frame between at least one transport position and at least one working position, and wherein the transport position is located such that a movement from the working position to the transport position comprises lowering the handle frame.

12. The floor grinding machine as claimed in claim 1, wherein, when both the first locking device and the second locking device are in a locked state, rotation of the guide member relative the handle frame and the machine frame is prevented.

13. The floor grinding machine as claimed in claim 1, wherein the first locking device comprises a first locking pin and a first plurality of locking holes that are selectively engageable with the first locking pin to lock the handle frame in a position relative to the guide member;

wherein the second locking device comprises a second locking pin and a second plurality of locking holes that are selectively engageable with the second locking pin to lock the machine frame in a position relative to the guide member.

14. The floor grinding machine as claimed in claim 13, wherein the first locking pin is affixed to the handle frame and the second locking pin is affixed to the machine frame;

wherein the first plurality of locking holes and the second plurality of locking holes are disposed on the guide member.

15. A method for setting a position of a handle of a floor grinding machine for grinding floor surfaces, the floor grinding machine comprising:

a machine frame, a grinding head supported by the machine frame, a motor supported by the machine frame and operatively connected to the grinding head, a handle frame extending from the machine frame and pivotable relative to the machine frame, a guide member which is pivotable relative to the machine frame and pivotable relative to the handle frame, a first locking device that selectively locks the guide member into physical engagement with the handle frame to prevent pivoting movement of the handle frame relative to the guide member, and a second locking device that selectively locks the guide member into physical engagement with the machine frame;

wherein the guide member is pivotable relative to the machine frame about a first axis, the handle frame is pivotable relative guide member about a second axis, and the first and second axes are coaxial;

wherein the handle frame is prevented from pivoting relative to the machine frame, in either rotational direction, when the first locking device locks the guide member into physical engagement with the handle frame and the second locking device locks the guide member into physical engagement with the machine frame;

wherein the method comprises:

setting a position of the handle frame relative to the guide member, and setting a position of the guide member relative to the machine frame.

16. The method as claimed in claim 15, wherein setting a position of the handle frame relative to the guide member comprises:

pivoting the handle frame relative to the machine frame and relative to the guide member, and locking the handle frame relative to the guide member.

17. The method as claimed in claim 15, wherein setting a position of the guide member relative to a machine frame comprises:

pivoting the handle frame with the guide member relative to the machine frame, and locking the guide member relative to the machine frame.

* * * * *